US007506550B2

(12) United States Patent
Ulfert et al.

(10) Patent No.: US 7,506,550 B2
(45) Date of Patent: Mar. 24, 2009

(54) APPARATUS AND METHOD FOR ASSESSING THE CONDITION OF AT LEAST ONE CIRCULATING BAND IN A PAPER MACHINE

(75) Inventors: Wolfgang Ulfert, Tettnang (DE); Ralf Pfifferling, Gerstetten (DE)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 11/951,439

(22) Filed: Dec. 6, 2007

(65) Prior Publication Data

US 2008/0087073 A1 Apr. 17, 2008

Related U.S. Application Data

(63) Continuation of application No. 10/942,164, filed on Sep. 16, 2004, now abandoned.

(30) Foreign Application Priority Data

Sep. 19, 2003 (DE) ..... 103 43 418

(51) Int. Cl.
*G01N 19/00* (2006.01)

(52) U.S. Cl. ..... 73/856.9; 162/198; 162/199; 162/263

(58) Field of Classification Search ..... 73/38, 73/865.9

See application file for complete search history.

(56) References Cited

U.S. PATENT DOCUMENTS 1,550,993 A 8/1925 Vickery ..... 162/199
4,892,621 A * 1/1990 Eskelinen ..... 162/198
5,026,005 A * 6/1991 Ehrola ..... 242/541.5
5,349,845 A 9/1994 Blom ..... 73/38
5,725,737 A 3/1998 Pikulik et al. ..... 162/263
6,270,628 B1 8/2001 Suomi et al. ..... 162/198
6,284,100 B1 9/2001 Shakespeare et al. ..... 162/198
6,773,551 B1 8/2004 Oechsle et al. ..... 162/198
6,971,261 B2 12/2005 Ischdonat et al. ..... 73/38
7,279,072 B2 10/2007 Muhonen et al. ..... 162/198
7,294,234 B2 * 11/2007 Munch et al. ..... 162/198
2002/0129914 A1 9/2002 Grabscheid et al. ..... 162/199

* cited by examiner

*Primary Examiner*—Lisa M Caputo
*Assistant Examiner*—Rachel Black
(74) *Attorney, Agent, or Firm*—Taylor & Aust, P.C.

(57) ABSTRACT

The invention relates to an apparatus for assessing the condition of at least one circulating band in a papermaking machine including a permeability measuring device, a moisture measuring device, a fiber web moisture measuring device, an evaluator, a reel-up and an other moisture measuring device. The permeability measuring device measures the permeability of the at least one circulating band. The moisture measuring device measures the moisture contained in the at least one circulating band. The fiber web moisture measuring device measures the moisture of the fiber web. The evaluator combines the permeability, the moisture of the at least one circulating band and the moisture of the fiber web to determine the condition of the at least one circulating band. The other moisture measurement device is coupled to the reel-up, and takes a moisture measurement of the fiber web made by the papermaking machine.

20 Claims, 2 Drawing Sheets

APPARATUS AND METHOD FOR ASSESSING THE CONDITION OF AT LEAST ONE CIRCULATING BAND IN A PAPER MACHINE

CROSS REFERENCE TO RELATED APPLICATIONS

This is a continuation of U.S. patent application Ser. No. 10/942,164 entitled "APPARATUS AND METHOD FOR ASSESSING THE CONDITION OF AT LEAST ONE CIRCULATING BAND IN A PAPER MACHINE", filed Sep. 16, 2004 now abandoned.

BACKGROUND OF THE INVENTION

1. Field of the Invention

The invention relates to an apparatus for assessing the condition of at least one circulating band, in particular of a water-absorbing dewatering band and/or a transfer band in a papermaking machine.

2. Description of the Related Art

In general, the prior art discloses apparatuses which permit a permeability measurement on the circulating dewatering band. However, such apparatuses have a disadvantage in that they measure a high permeability at holes, cracks or the like, a high permeability being an indication of a satisfactory quality of the dewatering band. Thus, those apparatuses, which measure only the permeability, supply erroneous information about the condition of the quality of the dewatering band, in particular at holes, cracks or the like.

In addition, the prior art discloses handheld devices for measuring the permeability and handheld devices for measuring the moisture of a dewatering band in a papermaking machine. In using these handheld devices, it is not possible for any continuous monitoring of the permeability and of the moisture of the dewatering band to be carried out during operation. In addition, such handheld devices have only a limited accuracy, with which frequently no satisfactory statements can be made about the condition of the dewatering band. However, in order to be able to ensure a satisfactory quality of a fibrous web to be produced, it is necessary to be able to measure the permeability and the moisture of the dewatering band during operation, the quality of the fibrous web to be produced also depends on the quality of the permeability measurement and the moisture measurement.

SUMMARY OF THE INVENTION

The object of the present invention is to improve the reliability and accuracy in assessing the condition of the at least one circulating band by way of an apparatus that measures the permeability of at least one circulating band.

The present invention achieves the objective by way of an apparatus having a device for measuring the moisture contained in the at least one band. Thus, the apparatus according to the invention supplies further information about the state of the at least one circulating band. If, therefore, a high permeability is measured at a hole, at a crack or the like, a moisture level which is very low will be detected at the hole, at the crack or the like. From the simultaneous presence of a high permeability and a very low moisture, it is then possible to conclude that there is a hole, a crack or the like. Since the apparatus, according to the present invention, permits the measurement of the permeability and of the presence of moisture during operation, it is able to continuously supply accurate information about the instantaneous state of the at least one circulating band. Since continuous monitoring of the condition of the at least one circulating band is possible, the production of a high quality fibrous web is ensured.

It is possible to carry out the moisture measurement simultaneously or with a time offset in relation to the measurement of the permeability. However, the time interval between the permeability measurement and the moisture measurement should be no more than five hours, since the at least one circulating band changes over time. If the time interval between the permeability measurement and the moisture measurement is too great, soiling on the at least one circulating band or wear of the at least one circulating band can distort the information obtained.

If the moisture measurement and the measurement of the permeability are carried out at the same point on the at least one circulating band, very accurate information, with regard to the condition of the at least one circulating band, can be obtained. For this purpose, the measurement points for the permeability and moisture measurement are located one after another as viewed in the band running direction. The distances between the two measurement points are expediently relatively short so that, taking the high band speeds into account, a virtually simultaneous measurement of the two measured values can be carried out.

However, it is also possible to carry out the moisture measurement and the measurement of the permeability at different points of the at least one circulating band. Then, for example, the two measuring points can be arranged transversely with respect to the band running direction; in this case, too, the distances between the two measurement points should be relatively short, in order to obtain the most reliable information possible about the condition of the at least one circulating band. If the moisture and the permeability are measured at different points of the at least one circulating band and the distances between the two measuring points are relatively short, it is possible, by computation, to associate one measuring point, for example, the measuring point at which the moisture is measured, with the other measuring point, for example, the measuring point at which the permeability is measured.

The apparatus, according to the present invention can advantageously also have a device for measuring the band temperature. Thus, during operation, the temperature of the at least one circulating band can be measured. The band temperature likewise supplies information about the condition of the at least one circulating band. For example, the band temperature at soiled points, holes, cracks and the like differs from the band temperature at clean or fault-free points of the band. In addition, the measured band temperature can be useful for controlling the temperature of a measuring fluid needed for the permeability measurement.

In a development of the present invention, the apparatus, on a reel-up, has a device for the measurement of moisture of a material web, in particular a fibrous web. It is likewise possible for the apparatus, according to the present invention, to have, after a press section, a moisture measurement device of the material web, in particular the fibrous web. If the at least one circulating band is a dewatering band, its condition directly affects the moisture of the material web to be produced. Thus, the measured moisture of the material web, at the reel-up and/or in the press section, provides information about the condition of the at least one circulating band.

In addition, the apparatus can be provided with a device for determining the grammage of the material web, in particular the fibrous web. If the at least one circulating band is a dewatering band, its quality also directly affects the grammage of the material web to be produced. Thus, the grammage of the material web also provides information about the condition of the at least one circulating band.

Since the at least one circulating band discharges heat to the machine house surroundings during operation, the distribution of the machine house temperature along its width supplies information about its condition. At the points at which the at least one circulating band is highly soiled or has holes, cracks or the like, the heat emission varies. In addition, by using the device for measuring the machine house temperature and the device for measuring the band temperature, the difference between the two temperatures, along the width of the at the least one circulating band, can be determined. From this information statements about the condition of the band can be made. The device for measuring the machine house temperature can expediently be arranged on a cleaning assembly for cleaning the at least one circulating band.

Since the thickness of the at least one circulating band additionally permits a statement about its condition, the apparatus can have a device for measuring the thickness of the at least one circulating band. Deposits increase its thickness, whereas band abrasion reduces its thickness.

The condition of the at least one circulating band is also directly related to the tensile stress prevailing in it. It is therefore expedient to equip the apparatus with a device for measuring the tensile stress prevailing in the at least one circulating band. High band abrasion, soiling on the at least one circulating band and other influences can increase the tensile stress.

In one embodiment of the present invention, the apparatus is equipped with a device for measuring the filler content of the material web. The fillers contained in the material web can block up the pores of the at least one circulating band. Thus, from the filler content of the material web, it is possible to draw conclusions about a level of soiling and/or about an increase in the soiling of the at least one circulating band.

In a further embodiment of the present invention, the apparatus has a device for measuring a pressure, which prevails in a nip between two rolls, and/or a device for measuring the thickness of the material web. Since at least one circulating band, as a dewatering band, also affects the thickness of the material web to be produced, the level of the pressure, which prevails in the nip between two rolls, also depends on its condition. Thus, the pressure in the nip between two rolls supplies information about the condition of the at least one circulating band. The measurement of the thickness of the material web can advantageously be made by measuring the web suction which prevails in the material web.

In a further embodiment of the present invention, the apparatus has a device for measuring at least one surface property of the material web, in particular the roughness, the soiling (pigments, stock) and the like.

In yet another embodiment of the present invention, the apparatus has a steam blower box and/or a moistener. The steam outlet volume and/or moisture volume is regulated as a function of the condition of the at least one circulating band along the material web width. Thus, by using the steam blower box and/or the moistener, the quality of the material web to be produced can be evened out if this has been impaired by a worsening of the state of the at least one band. However, by using the steam blower box and/or the moistener, it is also possible to affect the condition of the at least one band.

In addition, the mixture ratio of a fiber and filler suspension and a dilution stream at a flow box, along the width of an outlet opening of a nozzle from which the mixture emerges, can be regulated as a function of the condition of the at least one circulating band along the material web width. Since the fibers and fillers contained in the material web to be produced can soil the at least one circulating band, the mixture ratio can be changed by increasing the dilution stream in such a way that the soiling of the at least one circulating band is reduced.

In addition, the present invention relates to a method for assessing the condition of the at least one circulating band. In particular of the water-absorbing dewatering band and/or transfer band in the papermaking machine. The permeability of the at least one circulating band is measured, and the moisture contained in the at least one circulating band is also measured. In addition, it is possible to measure the band temperature with the method according to the present invention.

Furthermore, by using the method according to the present invention, the moisture of the material web at the reel-up, and/or the moisture of the material web after the press section, and/or the grammage of the material web, and/or the pressure in the nip between two rolls, and/or the machine house temperature prevailing along the material web width, and/or the thickness of the at least one circulating band, and/or the tensile stress prevailing in the at least one circulating band and/or the filler content of the material web, and/or the thickness of the material web can be measured.

By using the method according to the present invention, the steam outlet volume, emerging from the steamer blower box, can also be regulated as a function of the condition of the at least one circulating band along the material web width.

It is likewise possible, by using the method of the present invention, for the moisture volume, emerging from the moistener, to be regulated as a function of the condition of the at least one band along the material web width. Furthermore, the mixture ratio of the fiber and filler suspension and the dilution stream at the flow box, along the width of the outlet opening of the nozzle from which the mixture emerges, can be regulated as a function of the condition of the at least one band along the material web width.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
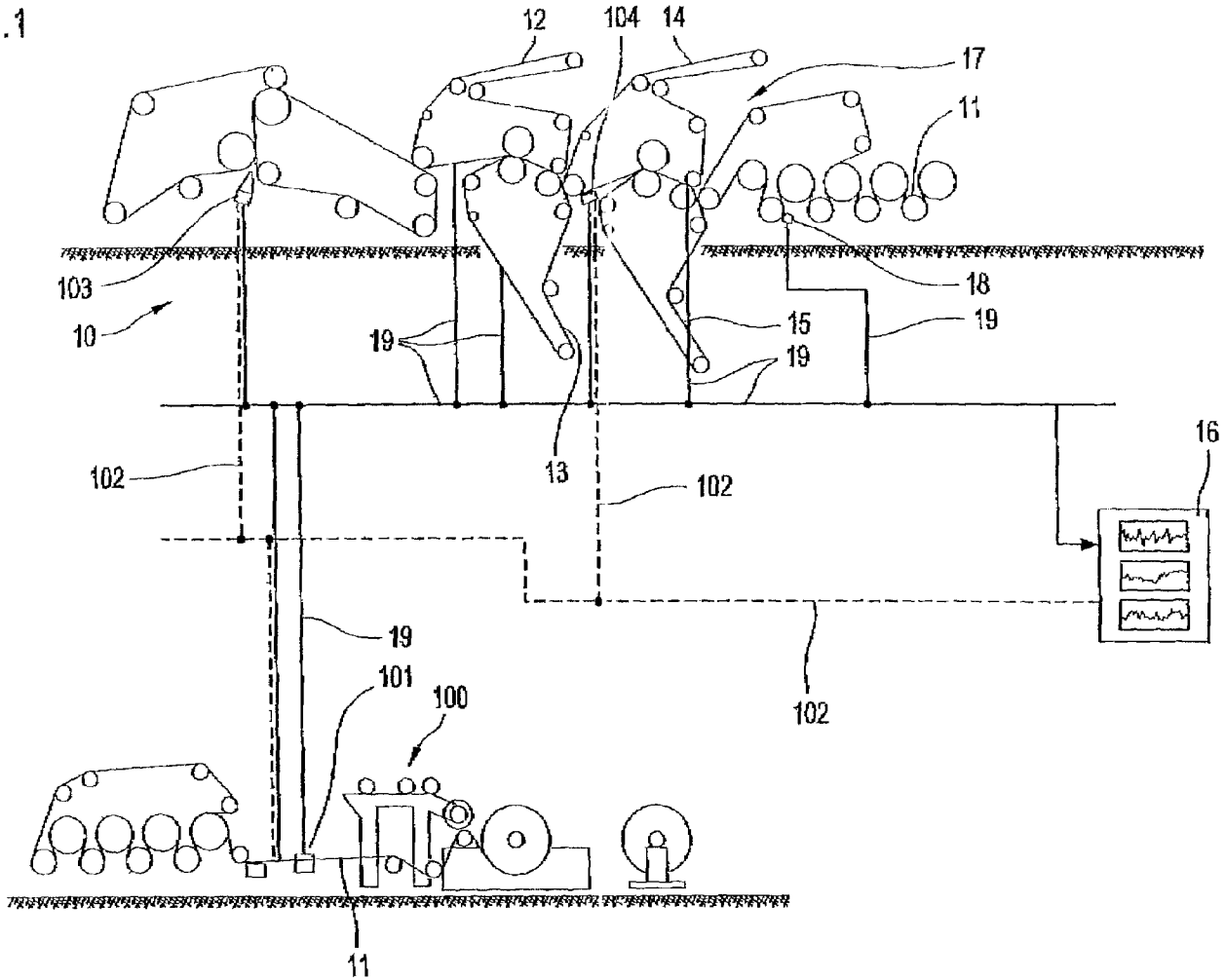
FIG. 1 is shows a schematical side view of an embodiment of a papermaking machine of the present invention.

Referring now to the drawings, and more particularly to FIG. 1, which shows a side view of a papermaking machine 10, with which a material web 11 is produced. Material web 11 can be a paper, board or tissue or other fibrous web. Papermaking machine 10 has various circulating bands 12, 13, 14 and 15. In the example illustrated, band 12 performs the function of a first top felt picking up material web 11, band 13 the function of a first bottom felt, band 14 the function of a second top felt and band 15 the function of a second bottom felt. However, band 15 can also be a transfer band.

Figure 2:
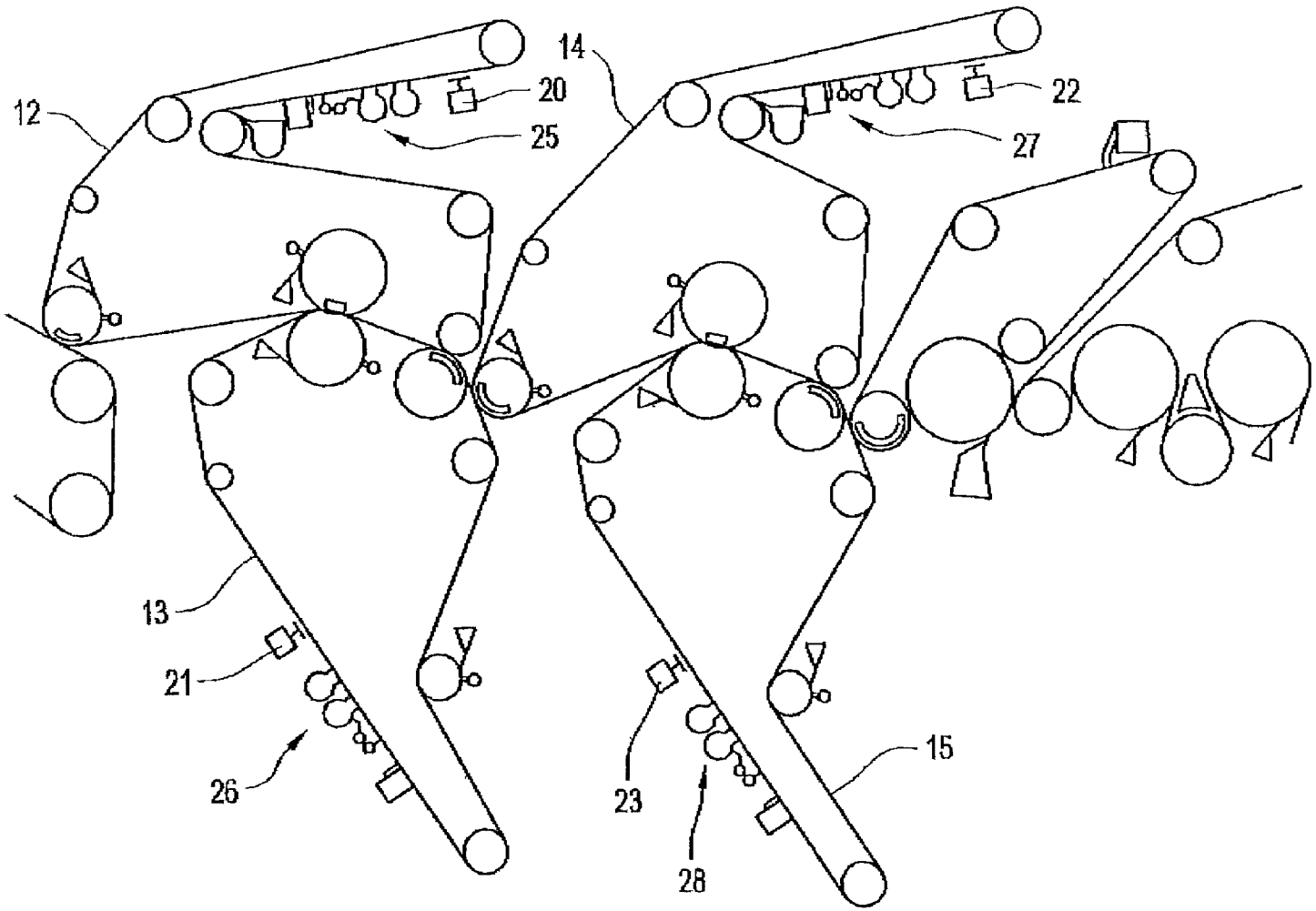
FIG. 2 is shows a schematical side view of a press section of the papermaking machine of FIG. 1.

Now, additionally referring to FIG. 2, bands 12, 13, 14 and 15 are provided with measuring devices 20, 21, 22 and 23. Measuring devices 20, 21, 22 and 23 are equipped with devices, not shown specifically here, for measuring the permeability and/or the moisture of bands 12, 13, 14 and 15. In this way, reliable information can be obtained about the condition of bands 12, 13, 14 and 15. If a high permeability is measured, this can indicate bands 12, 13, 14 or 15 are clean. However, it is also possible for bands 12, 13, 14 or 15 to have a hole, a crack or the like, so that in this case, too, a high permeability is measured. In order to rule out misinterpretations, which can result from the permeability measurement, the moisture measurement is additionally carried out. In order that the measuring result supplies reliable information, it is expedient to carry out the moisture measurement and the permeability measurement at the same measuring point, or at measuring points located close beside one another, on circulating bands 12, 13, 14 or 15. If a high permeability is measured in the permeability measurement and a very low moisture is measured in the moisture measurement, then these results allow the conclusion that there is a hole or a crack or the like in bands 12, 13, 14 or 15. Thus, the moisture measurement is an expedient supplement to the permeability measurement in order to assess the condition of bands 12, 13, 14 or 15. Apart from holes, cracks and the like, the soiling of bands 12, 13, 14 or 15 can also be detected by way of the combined permeability and moisture measurement. Then, by way of conditioning devices 25, 26, 27 and 28, soiled bands 12, 13, 14 or 15 can be cleaned. For this purpose, measuring devices 20, 21, 22 and 23 are connected via measuring signal lines 19 to an evaluation unit 16, which activates conditioning devices 25, 26, 27 or 28 as required in order to clean bands 12, 13, 14 or 15. If band 15 is a transfer band, conditioning device 28 is omitted. In addition, a device for measuring the temperature of bands 12, 13, 14 and 15 is provided in measuring devices 20, 21, 22 and 23.

At the end of a press section 17, papermaking machine 10 has a device 18 for measuring the moisture of material web 11 and, on a reel-up 100, a measuring device 101 is positioned for measuring the moisture of material web 11. The moisture measured with devices 18 and 101 provides information about the condition of bands 12, 13, 14 and 15. The moisture value measured by devices 18 and 101 is transmitted to an evaluation unit 16 by way of measuring signal lines 19.

In evaluation unit 16, all the measured values, including the measured values transmitted by measuring devices not specifically illustrated here, are evaluated and, if required, conditioning devices 25, 26, 27 and 28 are activated. In addition, a flow box 103 and a steam blower box 104 can be regulated by way of actuating signal lines 102 in accordance with the condition of bands 12, 13, 14 and 15.

In the case of the regulation of flow box 103, the mixture ratio of a fiber and filler suspension and a dilution stream at flow box 103, along the width of an outlet opening, not shown here, of a nozzle from which the mixture emerges, is regulated as a function of the condition of bands 12, 13, 14 and 15 along the width of material web 11. In order to avoid soiling of bands 12, 13, 14 and 15 by the fibrous stock and fillers, the dilution stream is increased during this regulation procedure.

In the case of the regulation of steam blower box 104, the steam outlet volume is regulated as a function of the condition of bands 12, 13, 14 and 15. In this way, with steam blower box 104, the quality of the material web to be produced can be balanced out if the latter has been impaired by a worsening of the condition of bands 12, 13, 14 and 15. In addition, the state of bands 12, 13, 14 and 15 can be acted on with steam blower box 104.

Thus, by way of the apparatus according to the present invention and by way of the method that can be carried out therewith, the measured values interacting with one another can be registered and evaluated, in order to be able to make appropriate changes in the process of the material web production and/or the conditioning of bands 12, 13, 14 and 15. By way of these appropriate changes, bands 12, 13, 14 and 15 are kept in a state which ensures the production of a qualitatively satisfactory material web.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for assessing a condition of at least one circulating band in a papermaking machine, comprising:

a permeability measuring device to measure the permeability of the at least one circulating band;

a moisture measuring device to measure the moisture contained in the at least one circulating band;

a fiber or material web moisture measuring device to measure the moisture of the fiber or material web;

an evaluator that combines the permeability, the moisture of the at least one circulating band and the moisture of the fiber material web to determine the condition of the at least one circulating band;

a reel-up; and an other moisture measurement device coupled to said reel-up, said other moisture measurement device taking a moisture measurement of the fiber material web made by the papermaking machine.

2. The apparatus of claim 1, wherein said moisture measuring device carries out a moisture measurement one of simultaneously and with a time offset relative to said permeability measuring device carrying out a permeability measurement.

3. The apparatus of claim 1, wherein said moisture measuring device carries out a moisture measurement at the same point on the at least one circulating band as said permeability measuring device carries out a permeability measurement.

4. The apparatus of claim 1, wherein said moisture measuring device carries out a moisture measurement at a different point on the at least one circulating band as said permeability measuring device carries out a permeability measurement.

5. The apparatus of claim 1, wherein said moisture measuring device carries out a moisture measurement at a point on the at least one circulating band that is proximate to where said permeability measuring device carries out a permeability measurement.

6. The apparatus of claim 1, wherein said permeability measuring device and said moisture measuring device provide measurements that jointly define a condition of the at least one band along a width of the fiber material web made by the papermaking machine, the papermaking machine including a steam blower box having a steam outlet volume that is regulated as a function of said condition.

7. The apparatus of claim 1, wherein said permeability measuring device and said moisture measuring device provide measurements that jointly define a condition of the at least one band along a width of the fiber or material web made by the papermaking machine, the papermaking machine including a moistener having a moisture volume emerging therefrom that is regulated as a function of said condition.

8. The apparatus of claim 1, wherein said permeability measuring device and said moisture measuring device provide measurements that define a condition of the at least one band along a width of the fiber or material web made by the papermaking machine, the papermaking machine having a dilution stream at a flow box and a mixture ratio of a fiber and filler suspension, said flow box including an outlet opening of a nozzle from which said suspension emerges, at least one of said mixture ratio and said dilution stream being regulated as a function of said condition.

9. The apparatus of claim 1, further comprising a grammage determining device positioned proximate to a portion of the fiber or material web, said grammage determining device configured to determine the grammage of the fiber or material web.

10. The apparatus of claim 1, further comprising a temperature measuring device positioned to measure a temperature which prevails along a width of the at least one circulating band.

11. The apparatus of claim 10, wherein the papermaking machine includes a cleaning assembly for cleaning the at least one circulating band, said temperature measuring device being arranged on said cleaning assembly.

12. The apparatus of claim 1, further comprising a thickness measuring device positioned to measure the thickness of one of the at least one circulating band and the fiber or material web made by the papermaking machine.

13. The apparatus of claim 1, further comprising a tensile stress measuring device for measuring the tensile stress prevailing in the at least one circulating band.

14. The apparatus of claim 1, further comprising a filler content measuring device for measuring the filler content of the fiber or material web made by the papermaking machine.

15. The apparatus of claim 1, further comprising a pressure measuring device for measuring a pressure, the papermaking machine including two rolls that are positioned to form a nip, said pressure measuring device measuring a pressure which prevails in said nip.

16. The apparatus of claim 1, further comprising a surface property measuring device for the measurement of a surface property of the fiber or material web made by the papermaking machine, said surface properties including at least one of roughness and soiling.

17. The apparatus of claim 1, wherein said permeability measuring device and said moisture measuring device provide measurements that jointly define a condition of the at least one band along a width of the fiber or material web made by the papermaking machine, the papermaking machine including at least one of a steam blower box having a steam outlet volume that is regulated as a function of said condition and a moistener having a moisture volume emerging therefrom that is regulated as a function of said condition.

18. A method for assessing the condition of at least one circulating band in a papermaking machine, comprising the steps of:

measuring a permeability of the at least one circulating band;

measuring moisture contained in the at least one circulating band;

winding a fiber or material web onto a reel-up;

measuring moisture in the fiber or material web using a moisture measuring device coupled to the reel-up;

evaluating the permeability, the moisture in the at least one circulating band and the moisture of the fiber or material web to determine the condition of the at least one circulating band, thereby avoiding soiling of the at least one circulating band; and regulating a mixture ratio of a fiber and filler suspension and a dilution stream at a flow box along a width of an outlet opening of a nozzle from which said mixture emerges as a function of a condition of the at least one band along the fiber or material web width and the moisture of the fiber or material web measured in the measuring moisture in the fiber web step.

19. The method of claim 18, further comprising the step of regulating a steam outlet volume from a steam blower box as a function of a condition of the at least one band along the material fiber or web width.

20. The method of claim 18, further comprising the step of regulating a moisture volume emerging from a moistener as a function of a condition of the at least one band along the fiber or material web width.

* * * * *